US009589515B2

(12) United States Patent
Yang et al.

(10) Patent No.: US 9,589,515 B2
(45) Date of Patent: Mar. 7, 2017

(54) DISPLAY PANEL AND DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventors: Kang Yang, Shanghai (CN); Jun Ma, Shanghai (CN); Tianyi Wu, Shanghai (CN); Hao Chen, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 36 days.

(21) Appl. No.: 14/213,237

(22) Filed: Mar. 14, 2014

(65) Prior Publication Data

US 2015/0015623 A1 Jan. 15, 2015

(30) Foreign Application Priority Data

Jul. 12, 2013 (CN) ..... 2013 1 0293612

(51) Int. Cl.
*G09G 3/36* (2006.01)

(52) U.S. Cl.
CPC ..... *G09G 3/3614* (2013.01); *G09G 3/3648* (2013.01); *G09G 2300/0426* (2013.01);
(Continued)

(58) Field of Classification Search
CPC ..... G09G 3/3648; G09G 3/3614; G09G 2300/0426; G09G 2320/0209; G09G 2320/0247; G09G 2300/0252
See application file for complete search history.

(56) References Cited

U.S. PATENT DOCUMENTS 6,552,707 B1 * 4/2003 Fujiyoshi ..... G09G 3/3648 345/100
2006/0202927 A1 * 9/2006 Lee ..... G02F 1/1368 345/88

(Continued)

FOREIGN PATENT DOCUMENTS

CN 1806190 A 7/2006
JP 2002082659 A 3/2002

(Continued)

OTHER PUBLICATIONS

1st Office Action as received in corresponding Chinese Application No. 201310293612.X, dated Jan. 19, 2016.

*Primary Examiner* — Sahlu Okebato
(74) *Attorney, Agent, or Firm* — Alston & Bird LLP

(57) ABSTRACT

A display panel and a display device are provided. The display panel includes a substrate, multiple data line groups which are arranged on the substrate sequentially and adjacently, and multiple gate line groups which are arranged on the substrate sequentially and adjacently. The display panel further includes multiple pixel electrode array units which are arranged in an array on the substrate. The pixel electrodes in the pixel electrode array unit are electrically connected with the data lines and the gate lines via switch elements. Data driving signals received by any two adjacent pixel electrodes in a same column have opposite polarities. The pixel electrode array unit includes a first pixel electrode, a second pixel electrode, a third pixel electrode, and a fourth pixel electrode. Data driving signals received by any two adjacent pixel electrodes of a same type in the same row have opposite polarities.

6 Claims, 1 Drawing Sheet

(52) U.S. Cl.
CPC ..... *G09G 2300/0452* (2013.01); *G09G 2320/0209* (2013.01); *G09G 2320/0247* (2013.01)

(56) References Cited

U.S. PATENT DOCUMENTS

| | | | | |
|---|---|---|---|---|
| 2007/0001953 | A1* | 1/2007 | Jang et al. | 345/88 |
| 2007/0091044 | A1* | 4/2007 | Park | G09G 3/3648 345/88 |
| 2008/0001889 | A1* | 1/2008 | Chun et al. | 345/96 |
| 2011/0227963 | A1* | 9/2011 | Su | G09G 3/3208 345/690 |
| 2011/0249046 | A1 | 10/2011 | Lee et al. | |

FOREIGN PATENT DOCUMENTS

| | | | |
|---|---|---|---|
| KR | 20080047882 | A | 5/2008 |
| KR | 101005903 | B1 | 1/2011 |

* cited by examiner

DISPLAY PANEL AND DISPLAY DEVICE

CROSS-REFERENCES TO RELATED APPLICATIONS

This application claims the benefit of priority to Chinese Patent Application No. 201310293612.X, filed with the Chinese Patent Office on Jul. 12, 2013 and entitled "DISPLAY PANEL AND DISPLAY DEVICE", the content of which is incorporated herein by reference in its entirety.

FIELD

The present disclosure relates generally to the field of display devices, and more particularly to a display panel and a display device.

BACKGROUND OF THE INVENTION

With increasing size and resolution of display panels, image quality deteriorates due to flicker and horizontal crosstalk. Flicker occurs when a display picture changes between dark and bright alternatively with alternating of multiple image frames. The horizontal crosstalk phenomenon is a phenomenon by which, if a certain color is displayed in a certain region of the display image, a gray level different from a predetermined gray level is displayed in regions located on the left and right sides of the certain region. Although various methods are proposed to prevent the phenomena of flicker and horizontal crosstalk of the display picture, existing solutions are usually only effective to prevent one phenomenon described above, that is, the flicker phenomenon and horizontal crosstalk phenomenon cannot be avoided simultaneously in existing display panels and displays. In addition, complex driving signals are usually required for the existing solutions to address the flicker problem. For example, the display panel is driven in a dot inversion driving mode, which results in a high power consumption of the display panel.

In view of the above, a display panel and a display device which can prevent a flicker phenomenon while avoiding a horizontal crosstalk phenomenon of the display picture are desired.

BRIEF SUMMARY OF THE INVENTION

Certain embodiments of the present invention provide a display panel and a display device. Specifically, a display panel according to an embodiment includes:

a substrate;

a plurality of data line groups which are arranged on the substrate sequentially and adjacently, where each of the data line groups includes a plurality of data lines which extend in a column direction and which are used for transmitting data driving signals, and polarities of the data driving signals transmitted by any two adjacent data lines are opposite;

a plurality of gate line groups which are arranged on the substrate sequentially and adjacently, where each of the gate line groups includes a plurality of gate lines which extend in a row direction and which are used for transmitting gate driving signals;

a plurality of pixel electrode array units which are arranged on the substrate in an array, where each of the pixel electrode array units corresponds to an area surrounded by one of the data line groups and one of the gate line groups crossing each other; pixel electrodes in each of the pixel electrode array units are electrically connected with the data lines and the gate lines via switch elements, and polarities of the data driving signals received by any two adjacent pixel electrodes in a same column are opposite;

where each of the pixel electrode array units comprises pixel electrodes of four types which are respectively a first pixel electrode, a second pixel electrode, a third pixel electrode and a fourth pixel electrode, and polarities of the data driving signals received by any two adjacent pixel electrodes of a same type in a same row are opposite.

According to another embodiment, a display panel includes:

a substrate;

a plurality of data line groups which are arranged on the substrate sequentially and adjacently, where each of the data line groups includes a plurality of data lines which extend in a column direction, the data lines are used for transmitting data driving signals, and polarities of the data driving signals transmitted by any two adjacent data lines are opposite;

a plurality of gate line groups which are arranged on the substrate sequentially and adjacently, where each of the gate line groups includes a plurality of gate lines which extend in a row direction, and the gate lines are used for transmitting gate driving signals;

a plurality of pixel electrode array units which are arranged on the substrate in an array, where each of the pixel electrode array units is located in an area surrounded by one data line group and one gate line group crossing each other; pixel electrodes in each of the pixel electrode array units are electrically connected with the data lines and the gate lines via switch elements; each column of the pixel electrodes in each of the pixel electrode array units comprises two pixel electrode groups, and each of the pixel electrode groups comprises at least two pixel electrodes which are arranged adjacently; polarities of the data driving signals received by pixel electrodes in a same pixel electrode group are the same, and polarities of the data driving signals received by any two adjacent pixel electrode groups in a same column are opposite;

where each of the pixel electrode array units comprises pixel electrode groups of four type which are respectively a first pixel electrode group, a second pixel electrode group, a third pixel electrode group and a fourth pixel electrode group; each of the pixel electrode array units comprises two parallel rows, and the pixel electrodes of each column in each parallel row belong to a same pixel electrode group; and polarities of the data driving signals received by the pixel electrodes in any two adjacent pixel electrode groups of a same type in a same parallel row are opposite.

The following description, together with the accompanying drawings, will provide a better understanding of the nature and advantages of the claimed invention.

DETAILED DESCRIPTION OF THE INVENTION

With increasing size and resolution of display panels, image quality deteriorates due to the phenomena of flicker and horizontal crosstalk. The present disclosure provides a display panel in which polarities of data driving signals received by any two adjacent pixel electrodes in a same column are opposite to each other, and polarities of data driving signals received by any two adjacent pixel electrodes of a same type in a same row are opposite to each other by designing the arrangement of the pixel electrodes and the connection way between the pixel electrodes and the data lines. Therefore, in accordance with the present invention, the flicker phenomenon and horizontal crosstalk phenomenon can be avoided during display. Moreover, compared with a dot inversion driving mode, the power consumption of the claimed invention is low.

Specific embodiments are described below. Those skilled in the art with access to the present disclosure will recognize that other display panels and display devices can also be designed within the scope of the claimed invention.

An Embodiment

According to an embodiment of the present invention, a display panel includes a substrate, multiple data line groups which are arranged on the substrate sequentially and adjacently, and multiple gate line groups which are arranged sequentially and adjacently on the substrate. Each of the data line groups includes multiple data lines which extend in a column direction, and the data lines are used for transmitting data driving signals. Each of the gate line groups includes multiple gate lines which extend in a row direction, and the gate lines are used for transmitting gate driving signals. The display panel also includes multiple pixel electrode array units which are arranged in an array on the substrate, each of the pixel electrode array units corresponds to an area surrounded by one data line group and one gate line group crossing each other.

It should be noted that, the row direction and the column direction described in the present disclosure are relative, any one direction in a plane may be defined as the row direction, and the direction perpendicular to the row direction is defined as the column direction.

Figure 1:
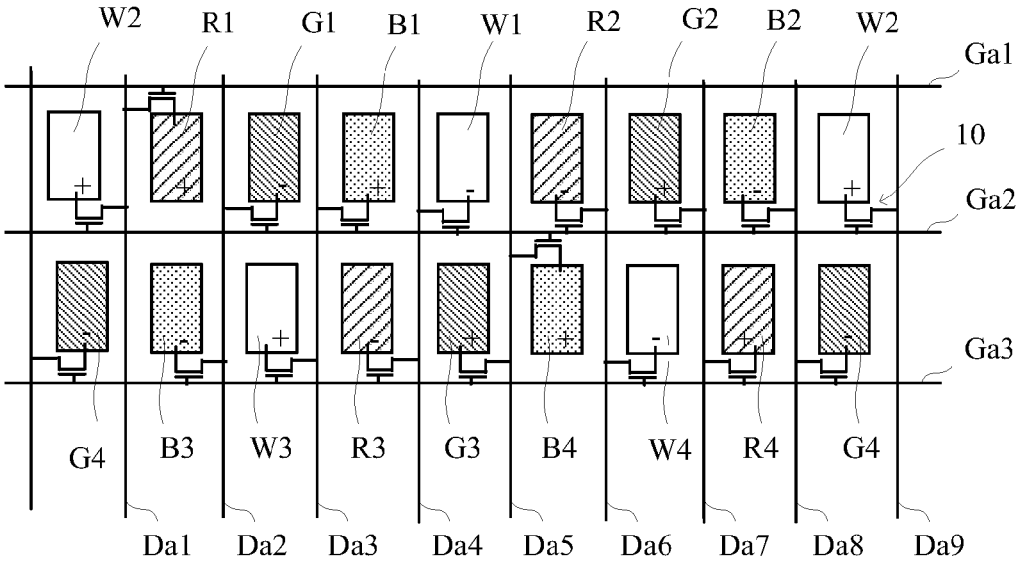
FIG. 1 is a simplified schematic diagram of a pixel electrode array unit in a display panel according to an embodiment of the disclosure.

FIG. 1 illustrates a pixel electrode array unit in the display panel according to an embodiment of the present invention. The pixel electrode array unit includes pixel electrodes of four types, which are respectively a first pixel electrode, a second pixel electrode, a third pixel electrode and a fourth pixel electrode. In this embodiment, the first pixel electrode may be associated with a red color filter, the second pixel electrode may be associated with a green color filter, the third pixel electrode may be associated with a blue color filter and the fourth pixel electrode may be associated with a white color filter. Alternatively, the pixel electrodes of four types may be associated with color filters of other colors according to different design requirement, for example, the pixel electrodes of four types may be associated with color filters having a same color, or be associated with color filters part of which having a same color, or may be associated with color filters each having a different color. In FIG. 1, the pixel electrodes of each type include 4 pixel electrodes, and a pixel electrode array unit includes 16 pixel electrodes. Specifically, in FIG. 1, the pixel electrodes of a same type are represented by a same pattern, and in the pixel electrodes of four types, the first pixel electrodes include first pixel electrodes R1 R2, R3, and R4, the second pixel electrodes include second pixel electrodes G1, G2, G3, and G4, the third pixel electrodes include third pixel electrodes B1, B2, B3, and B4, and the fourth pixel electrodes include fourth pixel electrodes W1, W2, W3, and W4.

Sixteen pixel electrodes in the pixel electrode array unit are arranged in an array of 8 columns×2 rows. In the embodiment, for the 4 first pixel electrodes, the first pixel electrode R1 is arranged at the first column in the first row of the pixel electrode array unit, the first pixel electrode R2 is arranged at the fifth column in the first row of the pixel electrode array unit, the first pixel electrode R3 is arranged at the third column in the second row of the pixel electrode array unit, and the first pixel electrode R4 is arranged at the seventh column in the second row of the pixel electrode array unit. For the 4 second pixel electrodes, the second pixel electrode G1 is arranged at the second column in the first row of the pixel electrode array unit, the second pixel electrode G2 is arranged at the sixth column in the first row of the pixel electrode array unit, the second pixel electrode G3 is arranged at the fourth column in the second row of the pixel electrode array unit, and the second pixel electrode G4 is arranged at the eighth column in the second row of the pixel electrode array unit. For the 4 third pixel electrodes, the third pixel electrode B1 is arranged at the third column in the first row of the pixel electrode array unit, the third pixel electrode B2 is arranged at the seventh column in the first row of the pixel electrode array unit, the third pixel electrode B3 is arranged at the first column in the second row of the pixel electrode array unit, and the third pixel electrode B4 is arranged at the fifth column in the second row of the pixel electrode array unit. For the 4 fourth pixel electrodes, the fourth pixel electrode W1 is arranged at the fourth column in the first row of the pixel electrode array unit, the fourth pixel electrode W2 is arranged at the eighth column in the first row of the pixel electrode array unit, the fourth pixel electrode W3 is arranged at the second column in the second row of the pixel electrode array unit, and the fourth pixel electrode W4 is arranged at the sixth column in the second row of the pixel electrode array unit.

For the above pixel electrodes arranged in an array, in the row direction, 8 pixel electrodes in the first row are respectively, from left to right, the first pixel electrode R1, the second pixel electrode G1, the third pixel electrode B1, the fourth pixel electrode W1, the first pixel electrode R2, the second pixel electrode G2, the third pixel electrode B2 and the fourth pixel electrode W2. Eight pixel electrodes in the second row are respectively, from left to right, the third pixel electrode B3, the fourth pixel electrode W3, the first pixel electrode R3, the second pixel electrode G3, the third pixel electrode B4, the fourth pixel electrode W4, the first pixel electrode R4 and the second pixel electrode G4.

Each of the 16 pixel electrodes in the pixel electrode array unit is electrically connected with the corresponding data line and gate line via a switch element 10, so that the pixel electrode can receive the corresponding data driving signal and gate driving signal. The switch element 10 may be a field effect transistor (such as a thin film transistor (TFT)), or may be other switch element. For convenience, only one switch element 10 is marked in FIG. 1.

It should be noted that in other embodiments of the disclosure, the 16 pixel electrodes described above may be arranged in other ways, and it is preferable that the pixel electrodes arranged in any 2 columns×2 rows include pixel electrodes of four types. In addition, in other embodiments of the disclosure, the first pixel electrodes, the second pixel electrodes, the third pixel electrodes and the fourth pixel electrodes may be in one-to-one way correspondence with the red color filters, the green color filters, the blue color filters and the white color filters in other manners.

Referring to FIG. 1, the pixel electrode array unit of the embodiment is located in the area surrounded by data lines Da1 to Da9 and gate lines Ga1 to Ga3. The data lines and the gate lines cross each other. Thus, the data lines from Da1 to Da9 form a data line group, and the gate lines from Ga1 to Ga3 form a gate line group. This is to be understood, in the embodiment, the number of the data lines included in one data line group is not 9 but 8. This is because the pixel electrodes in the display panel are arranged continuously and periodically, and the first data line and the last data line in each data line group both respectively belong to two different data line groups, thus the first data line and the last data line should be regarded as only one data line. For example, in the embodiment, the data line Da1 and the data line Da9 respectively belong to two different data line groups at a given time, thus the data line Da1 and the data line Da9 should be regarded as only one data line, and together with the 7 data lines from Da2 to Da8, the data line group includes 8 data lines in the embodiment. Similarly, in the embodiment, one gate line group includes 2 gate lines.

For the pixel electrode array unit and its corresponding data line group described in the embodiment, the data line Da1 is electrically connected with its left and right pixel electrodes in the first row. In FIG. 1, the data line Da1 is electrically connected with the first pixel electrode R1 on its right side in the first row via a switch element 10, but the structure on the left side of the data line Da1 is not shown in FIG. 1. Since the pixel electrodes in the display panel are arranged continuously and periodically, the structure on the left side of the data line Da1 may refer to as the structure on the left side of the data line Da9. It should be noted that, the electrode connected with the left side of the data line Da1 is not shown, and the data line Da9 is electrically connected with the fourth pixel electrode W2 on its left side in the first row. For convenience of analysis and description, in the embodiment, the fourth pixel electrode W2 is regarded as belonging to the pixel electrode array unit shown in FIG. 1, and the data line Da1 may be regarded as being electrically connected with the fourth pixel electrode W2, the pixel electrode in the first row electrically connected to the left side of the data line Da1 is regarded as belonging to another pixel electrode array unit, this consideration does not affect the solution of the disclosure substantially.

In the pixel electrode array unit and its corresponding data line group described in the embodiment, each of the data lines Da2, Da3, and Da4 is electrically connected with its left pixel electrode in the second row and its right pixel electrodes in the first row. Specifically, as shown in FIG. 1, the data line Da2 is electrically connected with the third pixel electrode B3 on its left side in the second row and the second pixel electrode G1 on its right side in the first row via two respective switch elements 10; the data line Da3 is electrically connected with the fourth pixel electrode W3 on its left side in the second row and the third pixel electrode B1 on its right side in the first row via two respective switch elements 10; the data line Da4 is electrically connected with the first pixel electrode R3 on its left side in the second row and the fourth pixel electrode W1 on its right side in the first row via two respective switch elements 10.

In the pixel electrode array unit and its corresponding data line group described in the embodiment, the data line Da5 is electrically connected with its left and right pixel electrodes in the second row. As shown in FIG. 1, the data line Da5 is electrically connected with the second pixel electrode G3 on its left side in the second row and the third pixel electrode B4 on its right side in the second row via two respective switch elements 10.

In the pixel electrode array unit and its corresponding data line group described in the embodiment, each of the data lines Da6, Da7, and Da8 is electrically connected with its left pixel electrode in the first row and its right pixel electrode in the second row. Specifically, as shown in FIG. 1, the data line Da6 is electrically connected with the first pixel electrode R2 on its left side in the first row and the fourth pixel electrode W4 on its right side in the second row via two respective switch elements 10; the data line Da7 is electrically connected with the second pixel electrode G2 on its left side in the first row and the first pixel electrode R4 on its right side in the second row via two respective switch elements 10; and the data line Da8 is electrically connected with the third pixel electrode B2 on its left side in the first row and the second pixel electrode G4 on its right side in the second row via two respective switch elements 10.

In the pixel electrode array unit described in the embodiment, in addition to being electrically connected with the corresponding data line, each pixel electrode is electrically connected with a corresponding gate line. Specifically, as shown in FIG. 1, the first pixel electrode R1 is electrically connected with a gate line Ga1 via a corresponding switch element 10; the second pixel electrode G1, the third pixel electrode B1, the fourth pixel electrode W1, the first pixel electrode R2, the second pixel electrode G2, the third pixel electrode B2, the fourth pixel electrode W2 and the third pixel electrode B4 are electrically connected with a gate line Ga2 via corresponding switch elements 10; and the third pixel electrode B3, the fourth pixel electrode W3, the first pixel electrode R3, the second pixel electrode G3, the fourth pixel electrode W4, the first pixel electrode R4 and the second pixel electrode G4 are electrically connected with a gate line Ga3 via corresponding switch elements 10. From the above description, each pixel electrode is connected with a corresponding data line and a corresponding gate line via a corresponding switch element 10. Preferably, if the switch element 10 is a TFT, a source of the TFT is electrically connected with a corresponding data line, a drain is electrically connected with the pixel electrode, and a gate is electrically connected with a corresponding gate line.

Therefore, an electrical connection structure is formed by all the 16 pixel electrodes in the pixel electrode array unit and the data lines from Da1 to Da9 and the gate lines from Ga1 to Ga3.

From the arrangement of the pixel electrodes in the pixel electrode array unit and the connection manner of the pixel electrodes with the data lines and the gate lines described in the embodiment, it is understood that, if only polarities of data signals transmitted by any two adjacent data lines are opposite to each other, polarities of data driving signals received by any two adjacent pixel electrodes in the same column are opposite and polarities of data driving signals received by any two adjacent pixel electrodes of the same type in the same row are opposite to each other.

Specifically, referring to FIG. 1, in the embodiment, positive symbols (+) and negative symbols (−) in the pixel electrodes are used to represent polarities of data driving signals received by the pixel electrodes. FIG. 1 illustrates the polarities of data driving signals received by the pixel electrodes at a given time, where the positive symbol (+) represents that the polarity of the data driving signal received by the pixel electrode is positive, and the negative symbol (−) represents that the polarity of the data driving signal received by the pixel electrode is negative.

At a given time, by making the polarities of the data signals transmitted by the data lines Da1, Da3, Da5, Da7, and Da9 positive and making the polarities of the data signals transmitted by the data lines Da2, Da4 Da6, and Da8 negative, the polarities of the data driving signals received by the first pixel electrode R1, the third pixel electrode B1, the second pixel electrode G2, the fourth pixel electrode W2, the fourth pixel electrode W3, the second pixel electrode G3, the third pixel electrode B4 and the first pixel electrode R4 are positive, and the polarities of the data driving signals received by the second pixel electrode G1, the fourth pixel electrode W1, the first pixel electrode R2, the third pixel electrode B2, the third pixel electrode B3, the first pixel electrode R3, the fourth pixel electrode W4 and the second pixel electrode G4 are negative. Therefore, the polarities of the data driving signals received by any two adjacent pixel electrodes in any one column are opposite. For example, the polarity of the data signal received by the first pixel electrode R1 is positive and the polarity of the data signal received by the third pixel electrode B3 is negative. In addition, the polarities of the data driving signals received by any two adjacent pixel electrodes of the same type in any one row are opposite, for example, in the first row, the polarity of the data signal received by the first pixel electrode R1 is positive, and the polarity of the data signal received by the first pixel electrode R2 is negative. Similarly, in another case which is not shown in FIG. 1, by making the polarities of the data signals transmitted by the data line Da1, the data line Da3, the data line Da5, the data line Da7 and the data line Da9 negative and making the polarities of the data signals transmitted by the data line Da2, the data line Da4, the data line Da6 and the data line Da8 positive, the polarities of the data driving signals received by all the 16 pixel electrodes are all inverted compared with the case of FIG. 1, i.e., the pixel electrode which receives the data driving signal with positive polarity in the case of FIG. 1 receives a data driving signal with negative polarity, and the pixel electrode which receives the data driving signal with negative polarity in the case of FIG. 1 receives a data driving signal with positive polarity, and in this case, the polarities of the data driving signals received by any two adjacent pixel electrodes in the same column are still opposite and the polarities of the data driving signals received by any two adjacent pixel electrodes of the same type in the same row are still opposite.

From the above analysis, if only, at any given time, the polarities of the data signals transmitted by adjacent data lines are set to be opposite to each other, the polarities of data driving signals received by any two adjacent pixel electrodes in the same column are opposite to each other and the polarities of data driving signals received by any two adjacent pixel electrodes of the same type in the same row are opposite to each other.

Another display panel is provided according to another embodiment of the disclosure. The composition, structure and property of the another display panel are the same as the composition, structure and property of the display panel provided by the foregoing embodiment, and the another display panel differs from the display panel of the foregoing embodiment in that, the first data line is electrically connected with its left and right pixel electrodes in the second row, each of the second data line, the third data line and the fourth data line each is electrically connected with its left pixel electrode in the first row and its right pixel electrode in the second row, the fifth data line is electrically connected with its left and right pixel electrodes in the first row, and each of the sixth data line, the seventh data line and the eighth data line is electrically connected with its left pixel electrode in the second row and its right pixel electrode in the first row.

In the liquid crystal display panel, in order to avoid abnormal orientation of the liquid crystal due to being in the electric field of the same type for a long term, the polarities of data driving signals received by a same pixel electrode are set to be different or opposite when displaying continuously two picture frames. For example, when the first picture frame is displayed, the polarity of the data driving signal received by a pixel electrode is positive, and when the second picture frame is displayed, the polarity of the data driving signal received by this pixel electrode is negative, and so on. It can be seen that, when a certain picture frame is displayed, the polarities of data driving signals received by all the pixel electrodes are all positive, and when the next picture frame is displayed, the polarities of data driving signals received by all the pixel electrodes are all negative. Although the voltage level of the data driving signal with positive polarity and the voltage level of the data driving signal with the negative polarity are generally set to be equal by a corresponding controller, the voltage levels of the data driving signal with positive polarity and the data driving signal with the negative polarity may deviate towards a same polarity such as the negative polarity since capacitive coupling occurs between the pixel electrode and the common electrode on the color filter panel. Therefore, the displayed picture is relatively dark when the polarities of data driving signals received by all the pixel electrodes are positive, and the displayed picture is relatively bright when the polarities of data driving signals received by all the pixel electrodes are negative, and in this case, flicker may occur on the liquid crystal display panel when different picture frames are updated quickly. However, according to this embodiment of the present invention, since the polarities of data driving signals received by any two adjacent pixel electrodes in the same column are opposite to each other, in any given time, half of pixel electrodes distributed uniformly receives data driving signals with a positive polarity and another half of pixel electrodes distributed uniformly receives data driving signals with a negative polarity at the same time. Therefore, flicker can be avoided for the liquid crystal display panel according to the embodiment of the present invention. Since when the polarities of data driving signals received by any two adjacent pixel electrodes of the same type in the same row are the same, electrical pulse with sharp edges may occur in different data lines, thereby leading to a horizontal crosstalk phenomenon. However, according to the embodiment of the present invention, the polarities of data driving signals received by any two adjacent pixel electrodes of the same type in the same row are opposite to each other, therefore, the horizontal crosstalk phenomenon can be avoided for the liquid crystal display panel. In addition, the power consumption of this embodiment is low due to a simple driving mode. According to the present invention, both the flicker phenomenon and the horizontal crosstalk phenomenon can be avoided for the display panel, and the power consumption is low.

Another Embodiment

Another display panel is provided by the embodiment of the disclosure. The display panel provided by the foregoing embodiment may be referred to in the embodiment providing the another display panel.

According to another embodiment of the present invention a display panel includes a substrate, multiple data line groups which are arranged on the substrate sequentially and adjacently and multiple gate line groups which are arranged on the substrate sequentially and adjacently. Each of the data line groups includes multiple data lines which extend in a column direction, and the data lines are used for transmitting data driving signals. Each of the gate line groups includes multiple gate lines which extend in a row direction, and the gate lines are used for transmitting gate driving signals. The display panel further includes multiple pixel electrode array units which are arranged on the substrate in an array, each of the pixel electrode array units corresponds to an area surrounded by one data line group and one gate line group crossing each other. For the above composition and structure of the display panel provided by this embodiment, the corresponding composition and structure of the display panel provided by the foregoing embodiment may be referred to.

Figure 2:
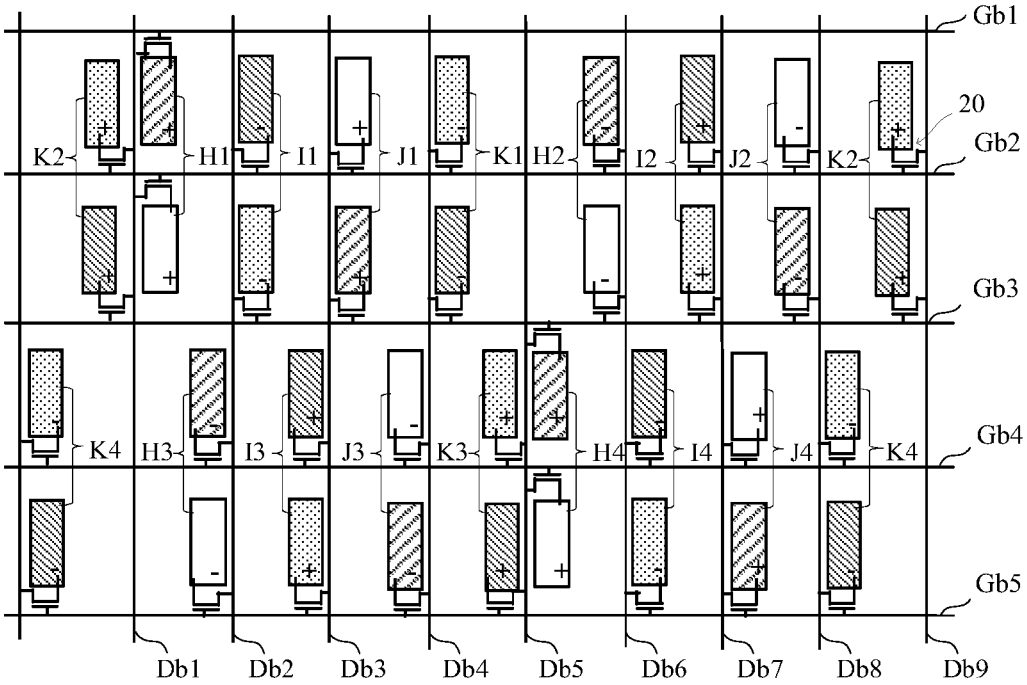
FIG. 2 is a simplified schematic diagram of a pixel electrode array unit in a display panel according to another embodiment of the disclosure.

FIG. 2 illustrates a pixel electrode array unit in the display panel provided by the embodiment. The pixel electrode array unit includes 32 pixel electrodes which are arranged in an array of 8 columns×4 rows. The 32 pixel electrodes include pixel electrodes of 4 types, and the number of the pixel electrodes of each type is 8. Specifically, in the embodiment shown in FIG. 2, pixel electrodes of the same type are represented by the same pattern; the pixel electrode at the first column in the first row is a first pixel electrode, the pixel electrode at the second column in the first row is a second pixel electrode, the pixel electrode at the third column in the first row is a third pixel electrode, and the pixel electrode at the fourth column in the first row is a fourth pixel electrode. Preferably, the pixel electrodes of four types may respectively correspond to a red color filter, a green color filter, a blue color filter and a white color filter. Alternatively, the pixel electrodes of four types may correspond to color filters with other colors which are not limited to the specific colors of red, green, blue or white. In other embodiments of the disclosure, the 32 pixel electrodes described above may also be arranged in other manners if only the pixel electrodes in any 2 columns×2 rows include pixel electrodes of 4 different types. In addition, in other embodiments of the disclosure, the first pixel electrodes, the second pixel electrodes, the third pixel electrodes and the fourth pixel electrodes may correspond in one to one way to the red color filters, the green color filters, the blue color filters and the white color filters in other manners, and the corresponding content of the foregoing embodiment may be referred to for the above content.

The 32 pixel electrodes of the pixel electrode array unit described in the embodiment may be arranged in an array of 8 columns×4 rows. The pixel electrode array unit includes the above pixel electrodes of four types; although the pixel electrodes of four types are not marked in FIG. 2 of the embodiment, the pixel electrodes of the same type are represented by the same pattern. Therefore, it can be seen that, the first pixel electrodes are arranged at the first column and the fifth column in odd rows (the first row and the third row in FIG. 2) and at the third column and the seventh column in even rows (the second row and the fourth row in FIG. 2) in the pixel electrode array unit. The second pixel electrodes are arranged at the second column and the sixth column in odd rows (the first row and the third row in FIG. 2) and at the fourth column and the eighth column in even rows (the second row and the fourth row in FIG. 2) in the pixel electrode array unit. The third pixel electrodes are arranged at the third column and the seventh column in odd rows (the first row and the third row in FIG. 2) and at the first column and the fifth column in even rows (the second row and the fourth row in FIG. 2) in the pixel electrode array unit; and the fourth pixel electrodes are arranged at the fourth column and the eighth column in odd rows (the first row and the third row in FIG. 2) and at the second column and the sixth column in even rows (the second row and the fourth row in FIG. 2) in the pixel electrode array unit.

In this embodiment, each column of pixel electrodes in the pixel electrode array unit includes two pixel electrode groups and each pixel electrode group includes two adjacent pixel electrodes, therefore, the pixel electrodes in 8 columns×4 rows include 16 pixel electrode groups. In addition, the pixel electrode array unit includes two parallel rows and each column of pixel electrodes in each parallel row belong to one pixel electrode group, therefore, pixel electrodes in one column in each parallel row is in one pixel electrode group, and 16 pixel electrode groups are arranged in an array of 8 columns×2 parallel rows.

In the pixel electrode array unit described in the embodiment, the 16 pixel electrode groups may be of four types, and the four types of pixel electrode groups are respectively a first pixel electrode group, a second pixel electrode group, a third pixel electrode group and a fourth pixel electrode group. Pixel electrode groups of each type include 4 pixel electrode groups. Specifically, the first pixel electrode groups include a first pixel electrode group H1, a first pixel electrode group H2, a first pixel electrode group H3 and a first pixel electrode group H4. The second pixel electrode groups include a second pixel electrode group I1, a second pixel electrode group I2, a second pixel electrode group I3 and a second pixel electrode group I4. The third pixel electrode groups include a third pixel electrode group J1, a third pixel electrode group J2, a third pixel electrode group J3 and a third pixel electrode group J4. The fourth pixel electrode groups include a fourth pixel electrode group K1, a fourth pixel electrode group K2, a fourth pixel electrode group K3 and a fourth pixel electrode group K4. In the pixel electrode array unit, the 16 pixel electrode groups are arranged as follows: 8 pixel electrode groups in the first parallel row are respectively, from left to right, the first pixel electrode group H1, the second pixel electrode group I1, the third pixel electrode group J1, the fourth pixel electrode group K1, the first pixel electrode group H2, the second pixel electrode group I2, the third pixel electrode group J2 and the fourth pixel electrode group K2; and 8 pixel electrode groups in the second parallel row are respectively, from left to right, the first pixel electrode group H3, the second pixel electrode group I3, the third pixel electrode group J3, the fourth pixel electrode group K3, the first pixel electrode group H4, the second pixel electrode group I4, the third pixel electrode group J4 and the fourth pixel electrode group K4.

It should be noted that in the embodiment, the first pixel electrode group includes, from top to bottom, a first pixel electrode and a third pixel electrode, the second pixel electrode group includes, from top to bottom, a second pixel electrode and a fourth pixel electrode, the third pixel electrode group includes, from top to bottom, a third pixel electrode and a first pixel electrode, the fourth pixel electrode group includes, from top to bottom, a fourth pixel electrode and a second pixel electrode. However, in other embodiments of the disclosure, the composition of each pixel electrode group may be different based on different arrangement of the pixel electrodes of four types.

Referring to FIG. 2, the pixel electrodes in the embodiment are connected with the corresponding data lines in a similar way as that in the foregoing embodiment, and the embodiment differs from the foregoing embodiment in that the pixel electrodes are connected with the corresponding data lines by using the pixel electrode group and the parallel row as units, specifically, the first data line is electrically connected with its left and right pixel electrode groups in the first parallel row; each of the second data line, the third data line and the fourth data line is electrically connected with its left pixel electrode group in the second parallel row and its right pixel electrode group in the first parallel row; the fifth data line is electrically connected with its left and right pixel electrode groups in the second parallel row; and each of the sixth data line, the seventh data line and the eighth data line is electrically connected with its left pixel electrode group in the first parallel row and its right pixel electrode group in the second parallel row. Specifically, the data line Db1 is electrically connected with the first pixel electrode group H1, and it can be known from the foregoing embodiment that in another pixel electrode array unit, the first data line is also considered to be electrically connected with the fourth pixel electrode group K2, the data line Db5 is electrically connected with the fourth pixel electrode group K3 and the first pixel electrode group H4, the data line Db2 is electrically connected with the first pixel electrode group H3 and the second pixel electrode group I1, the data line Db3 is electrically connected with the second pixel electrode group I3 and the third pixel electrode group J1, the data line Db4 is electrically connected with the third pixel electrode group J3 and the fourth pixel electrode group K1, the data line Db6 is electrically connected with the first pixel electrode group H2 and the second pixel electrode group I4, the data line Db7 is electrically connected with the second pixel electrode group I2 and the third pixel electrode group J4, and the data line Db8 is electrically connected with the third pixel electrode group J2 and the fourth pixel electrode group K4.

In the pixel electrode array unit of the embodiment, in addition to being electrically connected with the corresponding data line, each pixel electrode is also electrically connected with the corresponding gate line. Specifically, as shown in FIG. 2, in the first pixel electrode group H1, a first pixel electrode is electrically connected with a gate line Gb1 via a corresponding switch element 20, and a second pixel electrode is electrically connected with a gate line Gb2 via a corresponding switch element 20; in the second pixel electrode group I1, a first pixel electrode is electrically connected with the gate line Gb2 via a corresponding switch element 20 and a second pixel electrode is electrically connected with a gate line Gb3 via a corresponding switch element 20; in the third pixel electrode group J1, a first pixel electrode is electrically connected with the gate line Gb2 via a corresponding switch element 20 and a second pixel electrode is electrically connected with the gate line Gb3 via a corresponding switch element 20; in the fourth pixel electrode group K1, a first pixel electrode is electrically connected with the gate line Gb2 via a corresponding switch element 20 and a second pixel electrode is electrically connected with the gate line Gb3 via a corresponding switch element 20; in the first pixel electrode group H2, a first pixel electrode is electrically connected with the gate line Gb2 via a corresponding switch element 20 and a second pixel electrode is electrically connected with the gate line Gb3 via a corresponding switch element 20; in the second pixel electrode group I2, a first pixel electrode is electrically connected with the gate line Gb2 via a corresponding switch element 20 and a second pixel electrode is electrically connected with the gate line Gb3 via a corresponding switch element 20; in the third pixel electrode group J2, a first pixel electrode is electrically connected with the gate line Gb2 via a corresponding switch element 20 and a second pixel electrode is electrically connected with the gate line Gb3 via a corresponding switch element 20; in the fourth pixel electrode group K2, a first pixel electrode is electrically connected with the gate line Gb2 via a corresponding switch element 20 and a second pixel electrode is electrically connected with the gate line Gb3 via a corresponding switch element 20; in the first pixel electrode group H3, a first pixel electrode is electrically connected with a gate line Gb4 via a corresponding switch element 20 and a second pixel electrode is electrically connected with a gate line Gb5 via a corresponding switch element 20; in the second pixel electrode group I3, a first pixel electrode is electrically connected with the gate line Gb4 via a corresponding switch element 20 and a second pixel electrode is electrically connected with the gate line Gb5 via a corresponding switch element 20; in the third pixel electrode group J3, a first pixel electrode is electrically connected with the gate line Gb4 via a corresponding switch element 20 and a second pixel electrode is electrically connected with the gate line Gb5 via a corresponding switch element 20; in the fourth pixel electrode group K3, a first pixel electrode is electrically connected with the gate line Gb4 via a corresponding switch element 20 and a second pixel electrode is electrically connected with the gate line Gb5 via a corresponding switch element 20; in the first pixel electrode group H4, a first pixel electrode is electrically connected with the gate line Gb3 via a corresponding switch element 20 and a second pixel electrode is electrically connected with the gate line Gb4 via a corresponding switch element 20; in the second pixel electrode group I4, a first pixel electrode is electrically connected with the gate line Gb4 via a corresponding switch element 20 and a second pixel electrode is electrically connected with the gate line Gb5 via a corresponding switch element 20; in the third pixel electrode group J4, a first pixel electrode is electrically connected with the gate line Gb4 via a corresponding switch element 20 and a second pixel electrode is electrically connected with the gate line Gb5 via a corresponding switch element 20; in the fourth pixel electrode group K4, a first pixel electrode is electrically connected with the gate line Gb4 via a corresponding switch element 20 and a second pixel electrode is electrically connected with the gate line Gb5 via a corresponding switch element 20.

Therefore, an electrical connection structure is formed by all the 16 pixel electrode groups in the pixel electrode array unit and the data lines and gate lines connected via corresponding switch elements. From the arrangement of the pixel electrode groups in the pixel electrode array unit and the connection manner of the pixel electrode groups with the data lines and gate lines in the embodiment, it can be known if only the polarities of data signals transmitted by any two adjacent data lines are opposite, the polarities of data driving signals received by any two adjacent pixel electrode groups in the same column are opposite and the polarities of data driving signals received by any two adjacent pixel electrode groups of the same type in the same parallel row are opposite.

Referring to FIG. 2, in the embodiment, positive symbols (+) and negative symbols (−) in the pixel electrodes are used to represent the polarities of data driving signals received by the pixel electrodes, and FIG. 2 illustrates the polarities of data driving signals received by the pixel electrodes at some time, where the positive symbol (+) represents that the polarity of the data driving signal received by the pixel electrode is positive, and the negative symbol (−) represents that the polarity of the data driving signal received by the pixel electrode is negative. At that time, referring to FIG. 2, by making the polarities of the data signals transmitted by the data lines in odd columns (the data line Db1, the data line Db3, the data line Db5 and the data line Db7 in FIG. 2) positive and making the polarities of the data signals transmitted by the data lines in even columns (the data line Db2, the data line Db4, the data line Db6 and the data line Db8 in FIG. 2) negative, the polarities of the data driving signals received by the first pixel electrode group H1, the third pixel electrode group J1, the second pixel electrode group I2, the fourth pixel electrode group K2, the second pixel electrode group I3, the fourth pixel electrode group K3, the first pixel electrode group H4 and the third pixel electrode group J4 are positive, and the polarities of the data driving signals received by the second pixel electrode group I1, the fourth pixel electrode group K1, the first pixel electrode group H2, the third pixel electrode group J2, the first pixel electrode H3, the third pixel electrode group J3, the fourth pixel electrode group K4 and the second pixel electrode group I4 are negative. Therefore, at this time, the polarities of the data driving signals received by any two adjacent pixel electrode groups of a same type in any one column are opposite, for example, the polarity of the data signal received by the first pixel electrode group H1 is positive and the polarity of the data signal received by the first pixel electrode group H3 is negative; in addition, at this time, the polarities of the data driving signals received by any two adjacent pixel electrode groups of a same type in any one parallel row are opposite, for example, the polarity of the data signal received by the first pixel electrode group H1 is positive, and the polarity of the data signal received by the first pixel electrode group H2 is negative. Similarly, in another case which is not shown in FIG. 2, by making the polarities of data signals transmitted by the data lines in odd columns negative and making the polarities of data signals transmitted by the data lines in even columns positive, the polarities of the data driving signals received by all the 16 pixel electrode groups are all inverted compared with the case of FIG. 2, i.e., the pixel electrode which receives the data driving signal with positive polarity in the case of FIG. 2 receives a data driving signal with negative polarity, and the pixel electrode which receives the data driving signal with negative polarity in the case of FIG. 2 receives a data driving signal with positive polarity, and in this case, the polarities of the data driving signals received by any two adjacent pixel electrode groups in a same column are still opposite and the polarities of the data driving signals received by any two adjacent pixel electrode groups of a same type in a same parallel row are still opposite. From the above analysis, if only, at any time, the polarities of data signals transmitted by adjacent data lines are set to be opposite, the polarities of the data driving signals received by any two adjacent pixel electrode groups in a same column are opposite and the polarities of the data driving signals received by any two adjacent pixel electrode groups of a same type in a same parallel row are opposite.

It should be noted that one parallel row includes two rows of pixel electrodes in the embodiment. However, in other embodiments of the disclosure, one parallel row in the pixel electrode array unit may include 3 or 4 or more rows of pixel electrodes, and pixel electrodes in each column and each parallel row form one pixel electrode group whose received driving signals have a same polarities. For example, 4 or 8 adjacent pixel electrodes in a same column are regarded as one pixel electrode group, and correspondingly, the successive 4 or 8 rows of pixel electrodes form one parallel row. In any way, N adjacent pixel electrodes in a same column may form one pixel electrode group, to make the pixel electrodes in the pixel electrode array unit arranged in an array of 8 columns×2 parallel rows, where N is a positive integer greater than or equal to 2.

For the display panel provided by the embodiment, at any time, a half of pixel electrode groups distributed uniformly receive the data driving signals with positive polarities, and the other half of pixel electrode groups distributed uniformly receive the data driving signals with negative polarities. Therefore, the flicker phenomenon can be avoided for the display panel provided by the embodiment. In addition, since the polarities of data driving signals received by any two adjacent pixel electrode groups of the same type in a same parallel row are opposite and the polarities of data driving signals received by any two adjacent pixel electrode groups in a same column are opposite, the horizontal crosstalk phenomenon can be avoided for the display panel provided by the embodiment. In summary, both the flicker phenomenon and the horizontal crosstalk phenomenon can be avoided for the display panel provided by the embodiment. In addition, since the polarities of data driving signals received by pixel electrodes in a same pixel electrode group are the same at any time, the IC design may be correspondingly simplified, and the power consumption can be lowered while improving the IC driving efficiency.

Another Embodiment

A display device is provided by the embodiment of the disclosure. The display device includes the display panel provided by any of the above embodiments of the disclosure, and the display device may also include structures such as a backlight source or a package frame. Since the display device provided by the embodiment has the display panel provided by any of the above embodiments of the disclosure, a flicker phenomenon and a horizontal crosstalk phenomenon can be avoided in displaying a picture by the display device, and the power consumption is low compared with the existing dot inversion driving mode.

The disclosure is not limited to the above described embodiments. Various alternations and modifications can be made by those skilled in the art without deviating from the essence and the scope of the disclosure. Therefore, the scope of protection of the present disclosure should be based on the scope defined by the appended claims.

What is claimed is:

1. A display panel comprising:

a substrate;

a plurality of data line groups arranged in a column array on the substrate, each of the data line groups comprising a plurality of data lines extending in a column direction to transmit data driving signals, wherein data driving signals transmitted from two adjacent data lines have opposite polarities;

a plurality of gate line groups arranged in a row array on the substrate, each of the gate line groups comprising a plurality of gate lines extending in a row direction and for transmitting gate driving signals; and a plurality of pixel electrode array units arranged in an array on the substrate, each of the pixel electrode array units corresponding to an area gridded with one of the plurality of data line groups and one of the plurality of gate line groups each of the pixel electrode array units comprising a plurality of pixel electrodes that are electrically connected with the data lines and the gate lines via a plurality of switch elements, and data driving signals received by two adjacent pixel electrodes in the same column having opposite polarities;

wherein each of the pixel electrode array units comprises a first type pixel electrode, a second type pixel electrode, a third type pixel electrode, and a fourth type pixel electrode, each type is associated with one of the four colors red, green, blue, and white, wherein data driving signals received by two adjacent pixel electrodes of the same type disposed in the same row have opposite polarities, wherein each of the pixel electrode array units comprises:

4 first type of pixel electrodes being respectively arranged at the first column in the first row, a fifth column in the first row, a third column in the second row, and a seventh column in the second row, 4 second type of pixel electrodes being respectively arranged at a second column in the first row, a sixth column in the first row, a fourth column in the second row, and an eighth column in the second row, 4 third type of pixel electrodes being respectively arranged at the third column in the first row, the seventh column in the first row, the first column in the second row, and the fifth column in the second row, and 4 fourth type of pixel electrodes being respectively arranged at the fourth column in the first row, the eighth column in the first row, the second column in the second row, and the sixth column in the second row.

2. The display panel according to claim 1, wherein each of the data line groups comprises 8 data lines, and each of the gate line groups comprises 2 gate lines.

3. The display panel according to claim 2, wherein, for each of the pixel electrode array units and a corresponding data line group, a first data line is electrically connected with the pixel electrodes disposed on a left side and on a right side in a first row;

each of second, third, and fourth data lines is electrically connected with a pixel electrode disposed on the left side in a second row and the pixel electrode disposed on the right side in the first row;

a fifth data line is electrically connected with pixel electrodes disposed on the left side and on the right side in a second row; and each of sixth, seventh, and eighth data lines is electrically connected with a pixel electrode disposed on the left side in the first row and a pixel electrode disposed on the right side in the second row.

4. A display device, comprising a display panel, wherein the display panel comprises:

a substrate;

a plurality of data line groups arranged in a column array on the substrate, each of the data line groups comprising a plurality of data lines extending in a column direction and to transmit data driving signals, wherein data driving signals transmitted by any two adjacent data lines have opposite polarities;

a plurality of gate line groups arranged in a row array on the substrate, each of the gate line groups comprising a plurality of gate lines extending in a row direction and transmitting gate driving signals;

a plurality of pixel electrode array units arranged in an array on the substrate, each of the pixel electrode array units corresponding to an area gridded with one of the plurality of data line groups and one of the plurality of the gate line groups; each of the pixel electrode array units including a plurality of pixel electrodes electrically connected with the data lines and the gate lines via a plurality of switch elements, wherein data driving signals received by any two adjacent pixel electrodes in the same column have opposite polarities;

wherein each of the pixel electrode array units comprises a first type pixel electrode, a second type pixel electrode, a third type pixel electrode and a fourth type pixel electrode, each type is associated with one of the four colors—red, green, blue, and white, wherein data driving signals received by any two adjacent pixel electrodes of the same type in the same row have opposite polarities, wherein each of the pixel electrode array units comprises:

4 first type of pixel electrodes being respectively arranged at the first column in the first row, a fifth column in the first row, a third column in the second row, and a seventh column in the second row, 4 second type of pixel electrodes being respectively arranged at a second column in the first row, a sixth column in the first row, a fourth column in the second row, and an eighth column in the second row, 4 third type of pixel electrodes being respectively arranged at the third column in the first row, the seventh column in the first row, the first column in the second row, and the fifth column in the second row, and 4 fourth type of pixel electrodes being respectively arranged at the fourth column in the first row, the eighth column in the first row, the second column in the second row, and the sixth column in the second row.

5. The display device according to claim 4, wherein each of the data line groups comprises 8 data lines, and each of the gate line groups comprises 2 gate lines.

6. The display device according to claim 5, wherein for each of the pixel electrode array units and its corresponding data line group, a first data line is electrically connected with the pixel electrodes disposed on a left side and on a right side in a first row;

each of second, third, and fourth data lines is electrically connected with a pixel electrode disposed on the left side in a second row and a pixel electrode on the right side in the first row;

a fifth data line is electrically connected with the pixel electrodes disposed on the left side and on the right side in the second row; and each of sixth, seventh, and eighth data lines is electrically connected with a pixel electrode disposed on the left side in the first row and a pixel electrode on the right side in the second row.

* * * * *